US009540895B2

(12) United States Patent
Mackenzie et al.

(10) Patent No.: US 9,540,895 B2
(45) Date of Patent: Jan. 10, 2017

(54) FRICTION REDUCTION ASSEMBLY FOR A DOWNHOLE TUBULAR, AND METHOD OF REDUCING FRICTION

(75) Inventors: Gordon R. Mackenzie, Cypress, TX (US); Graeme K. Kelbie, Cypress, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 925 days.

(21) Appl. No.: 13/608,023

(22) Filed: Sep. 10, 2012

(65) Prior Publication Data

US 2014/0069639 A1 Mar. 13, 2014

(51) Int. Cl.

| | |
|---|---|
| ***E21B 23/14*** | (2006.01) |
| ***E21B 21/10*** | (2006.01) |
| ***E21B 23/04*** | (2006.01) |
| ***E21B 17/20*** | (2006.01) |
| ***E21B 34/06*** | (2006.01) |
| ***E21B 41/00*** | (2006.01) |

(52) U.S. Cl.

CPC ..... *E21B 23/14* (2013.01); *E21B 17/20* (2013.01); *E21B 21/10* (2013.01); *E21B 23/04* (2013.01); *E21B 34/066* (2013.01); *E21B 41/0085* (2013.01)

(58) Field of Classification Search

CPC ..... E21B 21/10; E21B 23/04; E21B 34/066; E21B 41/0085; E21B 7/24; E21B 31/005; E21B 28/00

See application file for complete search history.

(56) References Cited

U.S. PATENT DOCUMENTS

| | | | |
|---|---|---|---|
| 4,518,888 | A | 5/1985 | Zabcik |
| 5,009,272 | A | 4/1991 | Walter |
| 5,839,508 | A | 11/1998 | Tubel et al. |
| 6,237,701 | B1 | 5/2001 | Kolle et al. |
| 6,279,670 | B1 | 8/2001 | Eddison et al. |
| 6,555,926 | B2 | 4/2003 | Gondron |

(Continued)

FOREIGN PATENT DOCUMENTS

| | | | |
|---|---|---|---|
| EP | 0185111 | A1 | 6/1986 |
| GB | 2343465 | A | 10/2000 |

(Continued)

OTHER PUBLICATIONS

National Oilwell Varco, "Agitator Tool" Downhole, www.nov.com/downhole, D392001564-MKT-001, 2009, pp. 1-2.

(Continued)

*Primary Examiner* — Shane Bomar
*Assistant Examiner* — Wei Wang
(74) *Attorney, Agent, or Firm* — Cantor Colburn LLP

(57) ABSTRACT

A friction reduction assembly for a downhole tubular. The friction reduction assembly includes an electrically activated friction reduction sub. The sub includes a flowbore fluidically connected to a flowbore of the tubular and remaining open for fluid flow therethrough during both activated and non-activated states of the friction reduction sub. A friction reducer responsive to an indication of lockup of the tubular, wherein friction between the tubular and surrounding casing or borehole is reduced in an electrically activated state of the friction reduction sub. A method of reducing friction in a downhole tubular is also included.

11 Claims, 12 Drawing Sheets

(56) References Cited

U.S. PATENT DOCUMENTS

| | | | | |
|---|---|---|---|---|
| 7,077,205 | B2 | 7/2006 | Eddison | |
| 7,139,219 | B2 | 11/2006 | Kolle et al. | |
| 7,219,726 | B2 | 5/2007 | Zheng et al. | |
| 7,434,627 | B2 | 10/2008 | Turley et al. | |
| 7,487,828 | B2 | 2/2009 | Fincher et al. | |
| 7,708,086 | B2 | 5/2010 | Witte | |
| 8,134,476 | B2 | 3/2012 | Chemali et al. | |
| 8,162,078 | B2 | 4/2012 | Anderson | |
| 2008/0251254 | A1* | 10/2008 | Lynde | E21B 31/005 166/301 |
| 2009/0166045 | A1 | 7/2009 | Wetzel | |
| 2010/0212901 | A1 | 8/2010 | Buytaert | |
| 2010/0224412 | A1* | 9/2010 | Allahar | E21B 7/24 175/55 |
| 2011/0011594 | A1 | 1/2011 | Young | |
| 2012/0193145 | A1 | 8/2012 | Anderson | |

FOREIGN PATENT DOCUMENTS

| | | | |
|---|---|---|---|
| WO | 9746787 | A1 | 11/1997 |
| WO | 2008007066 | A1 | 1/2008 |

OTHER PUBLICATIONS

Tempress, "Extended-Reach Tool" HydroPull, www.tempresstech.com; Tempress Technologies , Inc. 2012, pp. 1-5.

Thru Tubing Solutions, "XRV", www.thrutubing.com; Oklahoma City, OK, Thur Tubing Solutions 2010-2012, pp. 1-3.

Notification of Transmittal of the International Search Report and the Written Opinion of the International Searching Authority, or the Declaration; PCT/US2013/054337; International Search Report 6 pages, Written Opinion 8 pages; Nov. 13, 2013.

International Search Report issued Dec. 17, 2015 re: Application No. PA 2015 00149; 8 pages.

* cited by examiner

FRICTION REDUCTION ASSEMBLY FOR A DOWNHOLE TUBULAR, AND METHOD OF REDUCING FRICTION

BACKGROUND

In the drilling and completion industry, the formation of boreholes for the purpose of production or injection of fluid is common The boreholes are used for exploration or extraction of natural resources such as hydrocarbons, oil, gas, water, and alternatively for CO2 sequestration. When coiled tubing is conveyed in highly deviated, long horizontal, lateral, up-dip, and even vertical boreholes, the tubing may reach a point of "lock-up" whereby the surface initiated snubbing force is insufficient to overcome the frictional forces between the coiled tubing and the casing or formation wall.

There have been some attempts at overcoming such frictional forces by incorporating a valve to cyclically interrupt flow within the tubing to create pressure pulses. While such pressure pulses are capable of reducing frictional forces between the coiled tubing and the borehole environment, the valve typically temporarily blocks the flowbore of the tubing thereby disrupting flow that could by used by other downhole tools or bottom hole assemblies.

Thus, the art would be receptive to improved alternative devices and methods for breaking or minimizing frictional forces to allow further transmission of a coiled tubing into a borehole.

BRIEF DESCRIPTION

A friction reduction assembly for a downhole tubular, the friction reduction assembly includes an electrically activated friction reduction sub including: a flowbore fluidically connected to a flowbore of the tubular and remaining open for fluid flow therethrough during both activated and non-activated states of the friction reduction sub; and a friction reducer responsive to an indication of lockup of the tubular; wherein friction between the tubular and surrounding casing or borehole is reduced in an electrically activated state of the friction reduction sub.

A method of reducing friction in a downhole tubular, the method including inserting a tubular having a flowbore into a borehole; sensing a lockup of the tubular within the borehole; powering an electrically activated friction reduction sub in response to a sensed lockup of the tubular, the friction reduction sub having a flowbore fluidically connected to the flowbore of the tubular and remaining open for fluid flow therethrough during both activated and non-activated states of the friction reduction sub; and reducing friction between the tubular and surrounding borehole in the activated state of the friction reduction sub.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
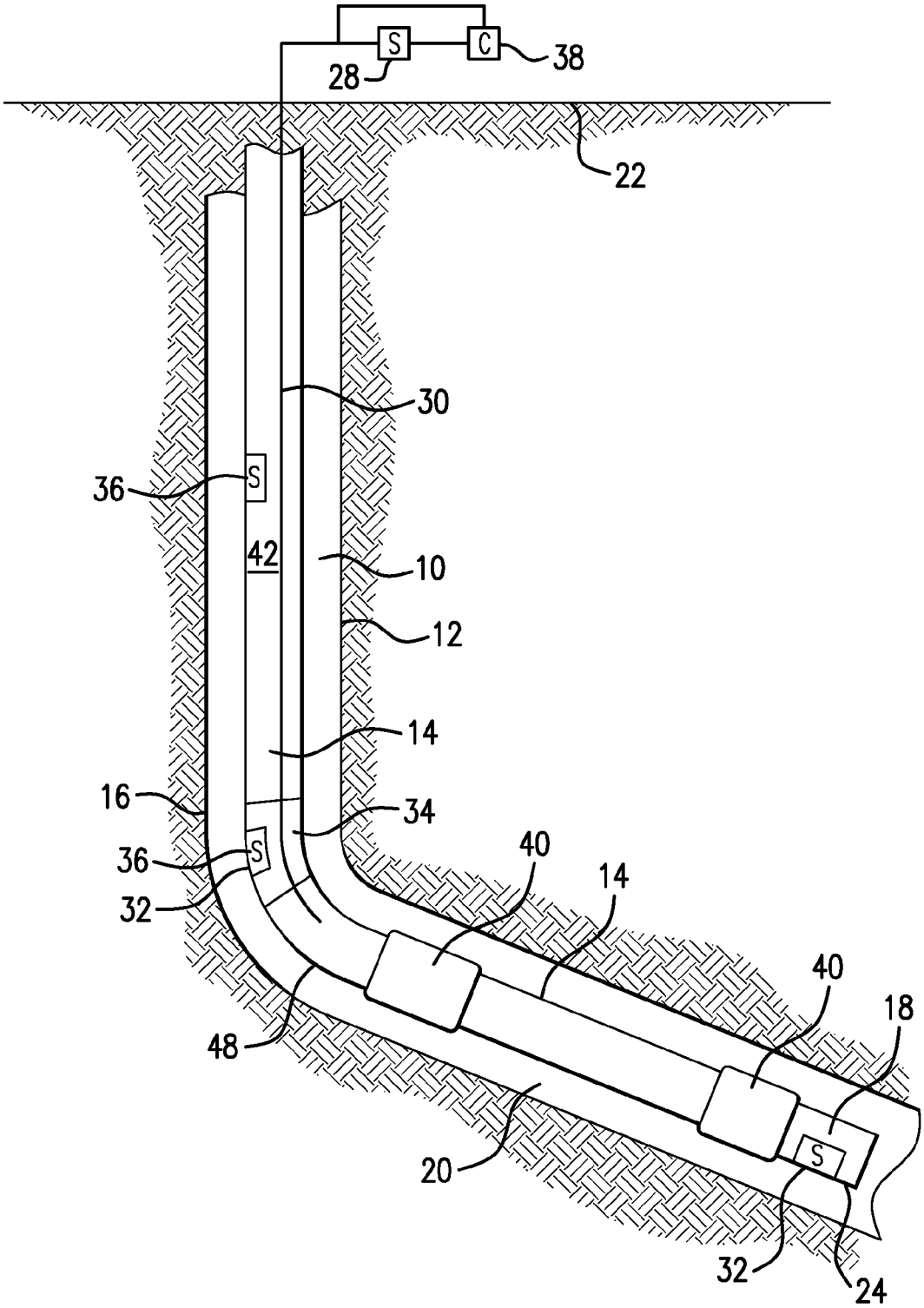
FIG. 1 shows a schematic diagram of a tubing in a borehole incorporating an exemplary friction reduction assembly.

FIG. 1 shows an exemplary borehole 10 lined with a casing 12, and has a generally vertical section as well as a deviated or horizontal section 20. Alternatively, the borehole 10 is an open-type borehole where the formation wall 16 is not lined with casing 12. Inserted within the borehole 10 is a tubing 14, such as, but not limited to, coiled tubing. The tubing 14 includes any number of connected tubing pieces and is spoolable onto a reel (not shown) provided at a surface location 22. The tubing 14 includes any pipe or tubing that is conveyed from the surface location 22 within borehole 10, such as a completion string, logging string, drill string, or any other type of string or piping employed in a downhole operation. At a downhole end 24 of the tubing 14, a tool 18 may be carried for performing a downhole operation. Delivery of the tool 18 into the borehole 10 requires the insertion of the tubing 14 through the vertical and horizontal sections of the borehole 10. In some circumstances, the tubing 14 may experience a "lock-up" where the surface initiated snubbing force is insufficient to overcome the frictional forces between the tubing 14 and the casing 12 or formation wall 16. For the purposes of describing a friction reduction assembly herein, a "lockup" is not meant to include a situation where the tubing 14 is purposely relatively immovable with respect to the casing 12 or formation wall 16, such as through the use of a packer or in a cementing operation. Instead, a lockup in the context of the description of a friction reduction assembly herein encompasses any situation where a desired entry of the tubing 14 into the borehole 10 is prohibited or made difficult, such as due to a frictional encounter with the casing 12 or formation wall 16, or due to a protuberance or other obstruction rendering the desired entry or even withdrawal of the tubing 14 difficult or impossible.

For coiled tubing applications, a tubing injector (not shown), can be used to move the tubing 14 from a source thereof, such as a reel, to the borehole 10. A sensor 28 may be provided at the surface location 22, such as at the injector or reel, to detect if the tubing 14 is experiencing a lockup from continued entry into the borehole 10, and sends a signal, such as via line 30. The sensor 28 could be one or more of a speed sensor to detect a change in speed of the tubing 14, a motion sensor to detect a cessation of motion of the tubing 14, a rotation sensor to detect a rotation change of a reel, etc. Alternatively, manual operator input, in response to operator detection of a lockup of the tubing 14, sends the detection signal via the line 30. In yet another alternative exemplary embodiment, a sensor module 32 is directly incorporated into the tubing 14 or tool 18 to detect changes in the motion of the tubing 14 through the borehole 10. The sensor module 32 could be incorporated into a logging bottom hole assembly 34, provided separately along interconnections of the tubing 14 or other locations along the tubing 14, or provided within the tool 18. The sensor module 32 may contain sensors 36, circuitry, and processing software and algorithms relating to the insertion parameters. Such parameters may include shocks, pressure, speed and acceleration measurements, and other measurements related to the condition of the tubing 14. Signals from sensors 36 in the sensor module 32 or sensors 36 provided elsewhere along the tubing 14 are either processed by the sensor module 32, sent to a surface location 22 such as surface control unit 38 for operator evaluation, or directly to a friction reduction assembly 40 for immediate or subsequent action. The surface control unit 38 or processor receives signals from the sensors 36 and processes such signals according to programmed instructions provided to the surface control unit 38. The surface control unit 38 may further display information on a display/monitor utilized by an operator. The surface control unit 38 may include a computer or a microprocessor-based processing system, memory for storing programs or models and data, a recorder for recording data, and other peripherals. The control unit 38 may be adapted to notify the operator when operating conditions indicate a lock-up. The surface control unit 38 may also be used for other operations of the tubing 14 and tool 18 not described herein. A communication sub (not shown) may obtain the signals and measurements and transfers the signals, using two-way telemetry, for example, to be processed at the surface location 22. Alternatively, the signals can be processed using a downhole processor in the tool 18 or sensor module 32. In the event a signal is sent indicating that the tubing 14 has encountered frictional forces with the borehole 10, the friction reduction assembly 40 is electrically activated, via input from the surface sensor 28, operator input through the controller 38, or from a downhole sensor 36, to assist the continued entry of the tubing 14 through the borehole 10 to successfully deliver the tool 18 to its destination. By electrically initiating the activation of the friction reduction assembly 40 only when friction reduction is required, the selective operation of friction reduction does not impede operation of the tool(s) 18, tubing 14, or any downhole procedure. Furthermore, as will be further described below, even when the friction reduction assembly 40 is activated, flow through a flowbore 42 of the tubing 14 is not blocked so as to allow for flow therethrough for use by the tool 18 or downhole operations requiring such flow.

Figure 2:
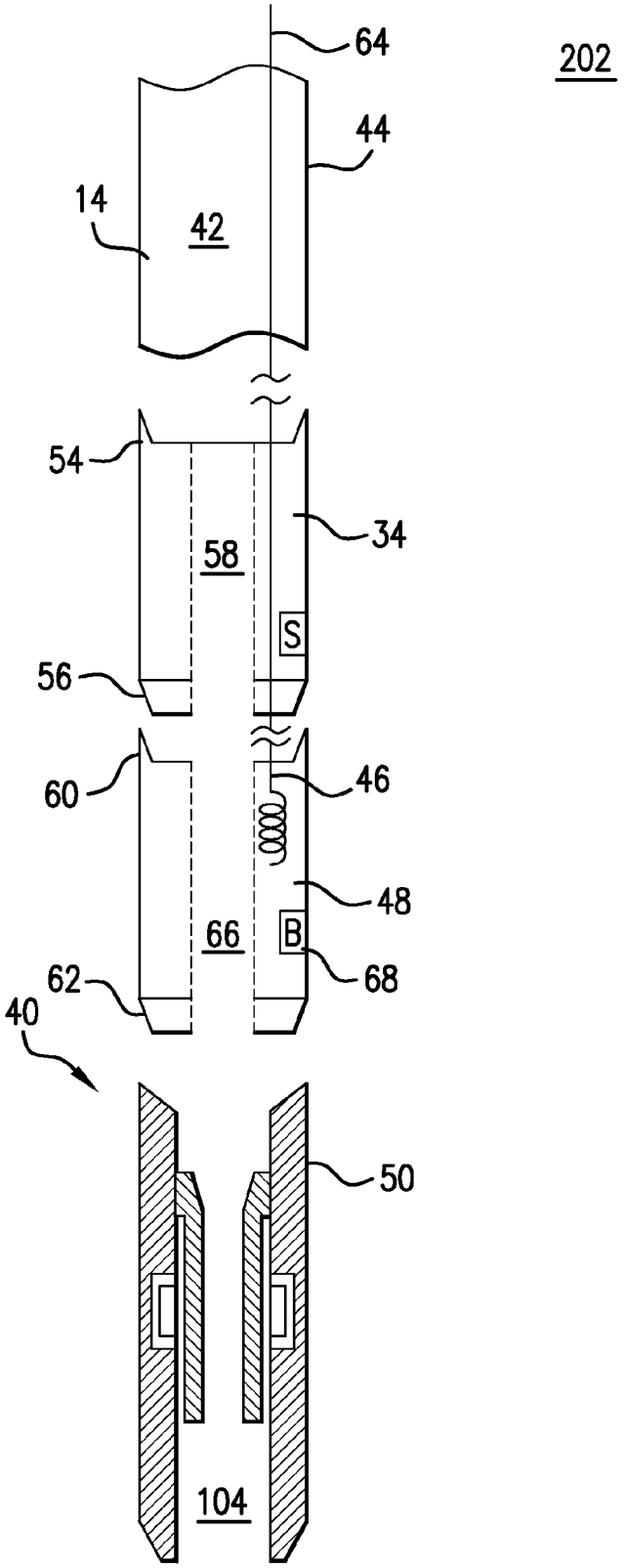
FIG. 2 shows a cross sectional exploded view of an exemplary embodiment of a friction reduction assembly.

Turning now to FIG. 2, the friction reduction assembly 40 is shown with the tubing 14. The tubing 14, including, but not limited to, deployment tubing, includes a tubular wall 44 surrounding the flowbore 42. While the friction reduction assembly 40 is shown downhole of the tubing 14, additional lengths of the tubing 14 may also be connected downhole of the friction reduction assembly 40. Additionally, multiple friction reduction assemblies 40 may be provided along the tubing 14 as exemplified in FIG. 1.

An exemplary embodiment of the friction reduction assembly 40 includes a logging bottom hole assembly ("BHA") 34, although the logging BHA may be a separate component from the friction reduction assembly 40. Also included in the friction reduction assembly 40 is a power supply 46, which may be incorporated into a power supply sub 48, and an electrically activated flow interruptor 50, also referred to herein as a friction reduction sub.

The logging BHA 34 is attachable to the tubing 14. The logging BHA 34 includes an uphole end 54 connected to the tubing 14, and a downhole end 56. The logging BHA 34 also includes flowthrough, such that a flowbore 58 of the logging BHA 34 is in fluid communication with the flowbore 42 of the tubing 14. The logging BHA 34 may create any type of geophysical log by making at least one type of measurement of rock or fluid property in the borehole 10 or within the flowbore 58 of the logging BHA 34 itself. The measurements are taken using at least one type of sensor, including, but not limited to, sensors to measure pressure, temperature, spontaneous potential, and radiation, as well as a variety of sensors such as acoustic (sonic), electric, inductive, magnetic resonance, etc. One of the sensors in the logging BHA 34 may be the sensor 36 that detects a frictional encounter with the borehole 10. The data from the measurements secured by the logging BHA 34 may be recorded at the surface control unit 38, or alternatively the logging BHA 34 may include a memory storage unit for subsequent creation of a well log. Since the information from the logging BHA 34 can be used by operators to gain an understanding of the borehole 10 for any desired downhole operation, the logging BHA 34 need not be directly part of the friction reduction assembly 40 even if information obtained from the logging BHA 34 is utilized by the friction reduction assembly 40. Alternatively, the friction reduction assembly 40 may be electrically operated using signals initiated by an operator or from other sensors 36, 28 as previously described.

Connected downhole of tubing 14, and the logging BHA 34 if utilized, is a power supply sub 48. The power supply sub 48 includes an uphole end 60 and a downhole end 62 and includes flowthrough via a flowbore 66. The uphole end 60 of the power supply sub 48 is connected downhole of the logging BHA 34 or tubing 14. In one exemplary embodiment, a conductor 64 passes through the tubing 14, logging BHA 34, and into the power supply sub 48. The conductor 64 is formed of one or more insulated wires or bundles of wires adapted to convey power and/or data, and may be included with or part of the signal conducting line 30 that delivers signals from the surface location 22. The conductor 64 can include metal wires, or alternatively other carriers such as fiber optic cables may be used. The conductor 64 can deliver the signal provided by the sensors 28 or operator input previously described, as well as carry the signals from the downhole sensors 36. Additionally, by use of either direct or alternating current transmittal through the conductor 64, the power supply sub 48 is capable of providing sufficient power to operate the friction reduction sub 50 connected downhole of the power supply sub 48. The conductor 64 is either provided within a protective channel (not shown) incorporated within the tubing 14 or passed through the flowbores 42, 58 of the tubing 14 and logging BHA 34, such as via a wireline. U.S. Pat. No. 7,708,086 to Witte, herein incorporated by reference in its entirety, describes the conveyance of power through jointed drill pipe or coiled tubing to a BHA using power and/or data transmission line. Advantages of using conductor 64 to conduct current from the surface 22 include the ability to conduct high amounts of electrical energy from the surface 22 and the supply from the surface 22 is relatively unlimited.

The power supply sub 48 may alternatively or additionally include a power storage unit such as one or more batteries 68. Batteries 68 can be used as a local source of power for downhole electrical devices, such as the electrically activated flow interruptor 50 or a tool 18, but the batteries 68 must be arranged to fit within space constraints that exist within the borehole 10 and tubing 14. Electrically recharging the battery 68 can occur through the conductor 64, and replacing the battery 68, if required, may be accomplished via a wireline operation or upon retrieval of the battery 68 from the borehole 10.

Figure 3A:
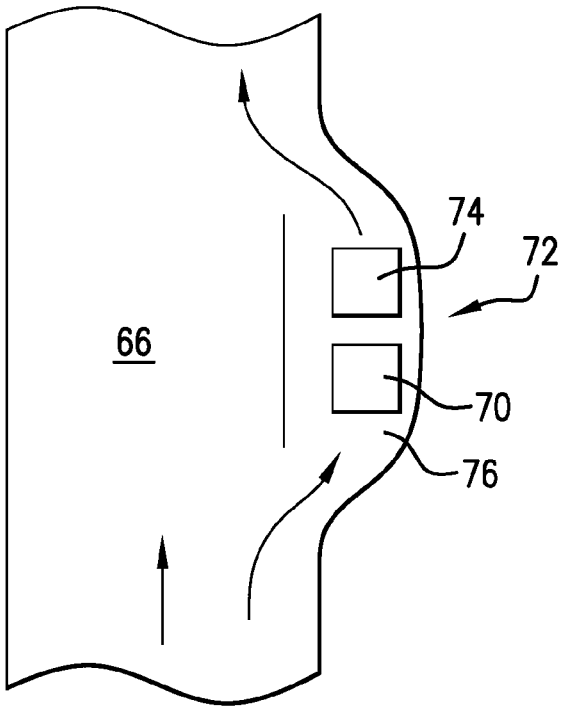
FIGS. 3A-3D show cross sectional views of alternate exemplary embodiments of a power generation sub for the friction reduction assembly of FIG. 2.
Figure 3B:
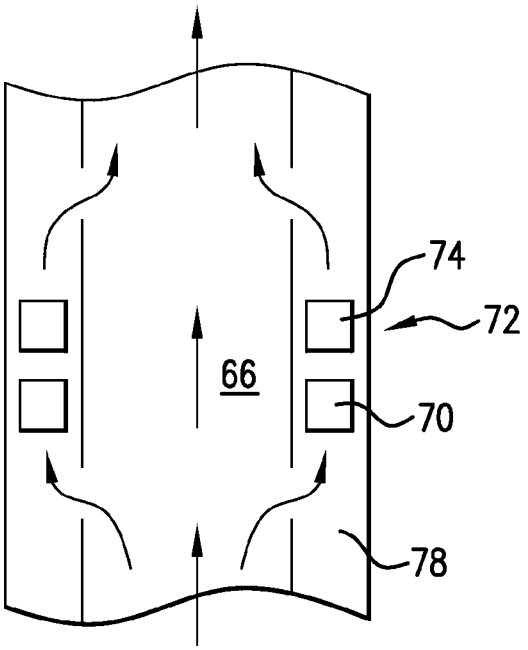
Figure 3C:
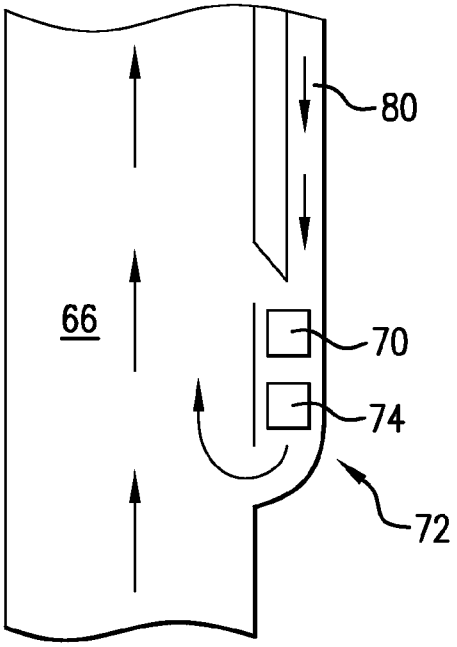

In other exemplary embodiments, the power supply sub 48 may additionally or alternatively include a downhole electrical generating mechanism 70 (FIGS. 3A-3D) that continuously generates electricity and supplies electricity as needed, such as the electrical generating apparatus described by U.S. Pat. No. 5,839,508 to Tubel et al, herein incorporated by reference in its entirety. The electrical generating mechanism 70 may utilize the power of passing fluid (hydraulic energy), magnetic field, a turbine, spring energy, piezoelectrics, etc. When the power supply sub 48 is employed as a power generation sub 72, power is scavenged, or harvested, from sources of potential energy within the borehole 10 including, but not limited to, mechanical vibration from the tubing 14 such as from a drill string and fluids moving inside the flowbore 66. The power generation sub 72 may harvest vibrational energy, such as the vibrational energy harvesting mechanism described by U.S. Patent Application 2009/0166045 to Wetzel et al. The flow through the flowbore 66 is a source of vibrational energy downhole, and vibration enhancement mechanisms as described in Wetzel et al. may be added in the flowbore 66 to produce a locally more turbulent flow. Additionally, as will be further described below, vibrations created by the friction reduction assembly 40 of the present invention are also harvestable by the power generation sub 72. When harvesting energy from the movement of fluid within the flowbore 66, the fluid can be used to rotate a rotatable element such as a turbine or a rotatable magnet within a coil. The rotating turbine can be connected to an electrical generator that communicates with an energy storage device, such as a battery 74. Rotation of a magnet within a coil will induce magnetic flux on the coil and a converter can convert AC electrical output to DC electrical energy as needed. As shown in FIG. 3A, the electrical generating mechanism 70 of the power generation sub 72 may occupy a lateral passageway 76 so as not to block the main flowbore 66, or may alternatively be positioned within an annulus 78 surrounding the flowbore 66 as depicted in FIG. 3B. Alternatively, as shown in FIG. 3C, hydraulic pressure from the surface 22 can be used to generate power in an electrical generating mechanism 70 by delivering fluid under pressure via a hydraulic line 80 to react with the electrical generating mechanism 70.

Figure 3D:
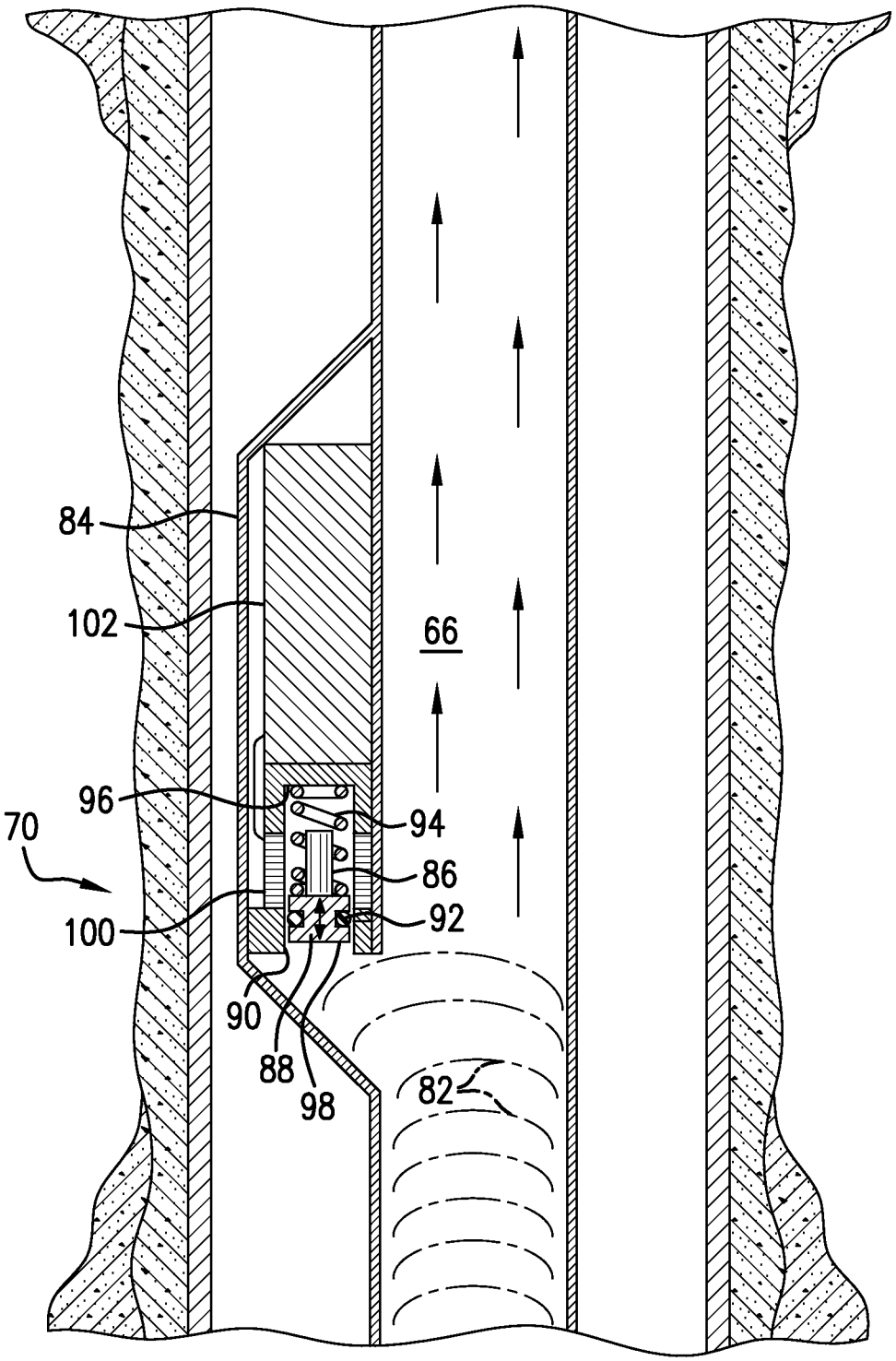

Energy can also be harvested within the tubing 14 when turbulence or pressure waves are induced by the flow interruptor 50, as will be further described below. One exemplary embodiment of generating power from the pressure waves 82 created by the flow interruptor 50 is shown in FIG. 3D. The electrical generating mechanism 70 is positioned in a lateral chamber 84 which is positioned outside of the flowbore 66 so as not to impede fluid movement through the flowbore 66. The electrical generating mechanism 70 includes a permanent magnet 86 which extends outwardly from a piston 88. Piston 88 sealingly engages a suitably sized cylinder 90 via seal 92. A spring 94 is sandwiched between piston 88 and the interior base 96 of cylinder 90. Spring 94 surrounds magnet 86. When a force urges the upper surface 98 of piston 88 downwardly, spring 94 will be compressed such that when the force on surface 98 is removed, spring 94 will urge upwardly to place piston 88 into its normal position. Positioned in facing alignment to the normal position of magnet 86 is a coil 100. Coil 100 in turn electrically communicates with an electronics and battery package 102. During operation, pressure waves 82 are directed from the flow interruptor 50 and impinge upon surface 98 of piston 88. The pressure waves 82 are delivered over a selected intermittent and timed sequence such that piston 88 will be sequentially urged upwardly when impinged by a pressure wave 82. During the time period that the pressure wave 82 has passed and before the next pressure wave 82 impinges upon piston 88, spring 94 will urge piston 88 downwardly to its normal position. As a result, piston 88 will undergo a reciprocating upward and downward motion whereby magnet 86 will similarly reciprocate within the annular opening defined between coil 100. The result is a magnetic flux which will generate electricity in a known manner and supply electricity to the appropriate electronics and battery package 102. In this exemplary embodiment of a power generation sub 72, the pulses from the friction reduction sub 50 are not only useful in reducing friction of the tubing 14, but are advantageously additionally used for generating power.

When determined by a surface operator or via the logging BHA 34 or sensor 36 or 28 that the tubing 14 has become "locked up" and surface initiated snubbing force is insufficient to overcome the frictional forces between the tubing 14 and the formation wall 16 or casing 12, then the power supply sub 48 will supply power to activate the electrically operated flow interruptor 50. The electrically operated flow interruptor 50 shares substantially the same flowpath, and likewise may share substantially the same longitudinal axis when interconnected with the power supply sub 48, logging BHA 34, and tubing 14. While the friction reduction sub 50, power supply sub 48, and logging BHA 34 have been described and illustrated as separate elements, another exemplary embodiment would include the integration of any combination of such subs, although separating the components into different subs generally eases replacement of defective parts. Also, while the different subs are described as interconnected, it should be understood that the elements may be separated from each other by any additional lengths of tubing 14 or connectors.

When powered by the power supply sub 48, the electrically operated flow interruptor 50 will create one of a sonic, magnetic, mechanical, and/or electrical event that temporarily and/or cyclically interrupts a fluid flow path in at least a portion of the flowbore 104 and 42 to create pressure waves 82/pulses at frequencies necessary to induce system friction reduction. A friction reducer of the flow interruptor 50 is accessible to the flow bore 104 of the friction reduction assembly 40, but does not block the flow bore 104 of the friction reduction assembly 40 even when in use, nor does it interrupt the normal flow through the flow bore 104 of the friction reduction assembly 40 and tubing 14. Thus, any downhole tools, such as tool 18, that depend on the flow through the flow bore 42 still receive the flow.

Figure 4A:
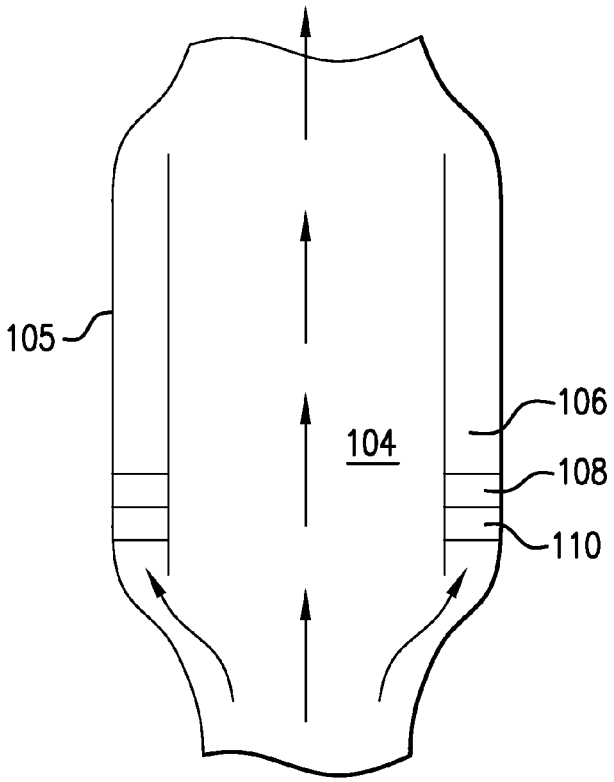
FIGS. 4A-4B show cross-sectional views of an exemplary embodiment of an annulus type friction reduction sub with a rotatable valve.
Figure 4B:
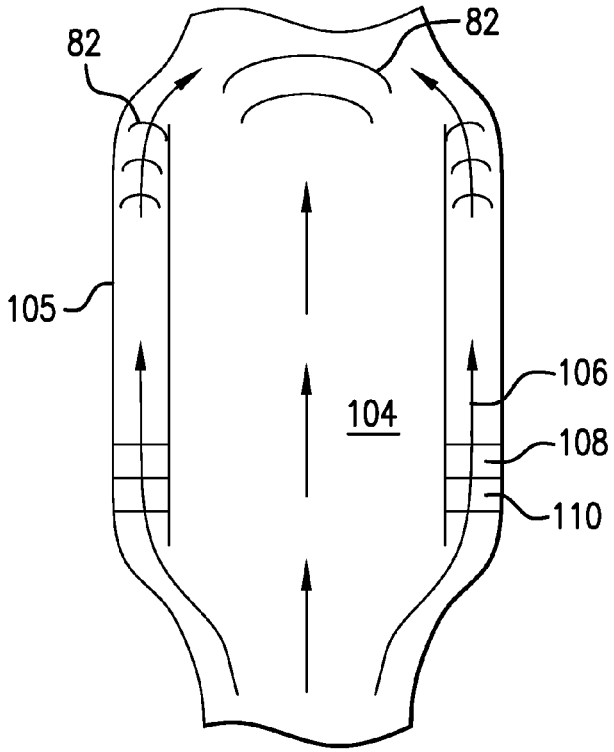
Figure 4C:
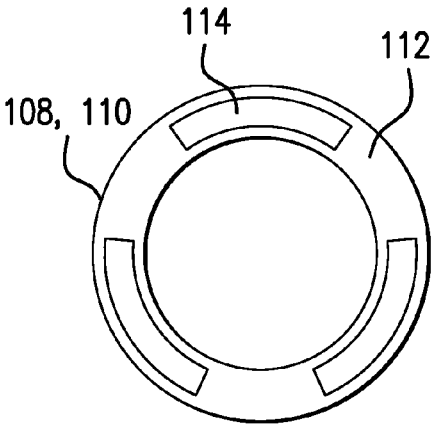
FIG. 4C shows a top plan view of a rotatable disk for the friction reduction sub.

As depicted in FIGS. 4A-4C, one exemplary embodiment of the flow interruptor 50 includes an annulus type flow interruptor 105 where the flow is blocked from entering the annulus 106 as shown in FIG. 4A until it is determined, such as via sensor 36, 28 or by operator knowledge, that the tubing 14 is resisting further entry into the borehole 10. When the flow interruptor 50 is activated, flow through the annulus 106 is enabled as shown in FIG. 4B and the flow is repeatedly blocked (FIG. 4A) and permitted (FIG. 4B) such that pulse waves 82 are created and passed into the flowbore 104, and fluidically connected flowbores 66, 58, 42 for creating friction reduction in the tubular 14. One exemplary embodiment for blocking and permitting the flow to pass through the annulus 106 includes flow control rings 108 and 110. One flow control ring, such as ring 108, is fixedly positioned within the annulus 106, while the other ring, such as ring 110, is rotatably positioned therein and under control of the power supply 46. In an unactivated condition, blocking areas 112 of the fixed flow control ring 108 are aligned with flowthrough areas 114 of the rotatable flow control ring 110, and blocking areas 112 of the rotatable flow control ring 110 are aligned with flowthrough areas 114 of the fixed flow control ring 108 so that no flow is permitted therethrough. When the ring 110 is activated to rotate, such as via a magnet moving towards and away a rim of the ring 110, the flowthrough areas 114 and blocking areas 112 of the rotatable flow control ring 110 alternate past the flowthrough areas 114 of the fixed flow control ring 108 to create the necessary pulse waves 82 to initiate friction reduction. Alternatively, a valve such as a sliding sleeve type valve blocks the entry and exit openings of the annulus 106 for a non-activated state of the friction reducer therein, and the valve is moved to open the entry and exit openings of the annulus 106 in an activated state of the friction reducer therein. In an alternative exemplary embodiment, the friction reducer is a pulser formed from a rotatable ring, such as ring 110 that moves by having fluid pushing past turbine blades formed therein, and another stationary element having an opening therein such that the fluid moves through the opening in pulses.

Figure 5:
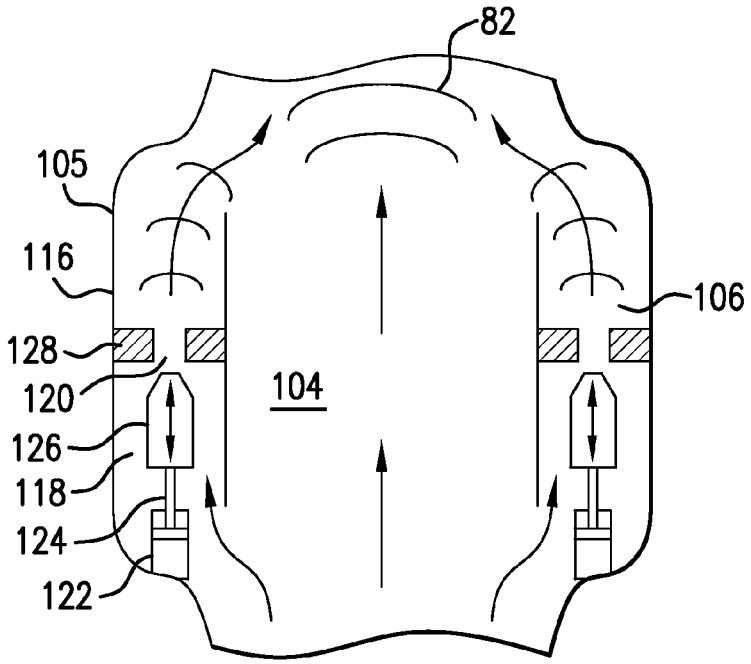
FIG. 5 shows a cross sectional view of an exemplary embodiment of an annulus type friction reduction sub with a choke assembly.

Another exemplary embodiment of a flow interruptor 116 is shown in FIG. 5 and includes an annulus type flow interruptor 105 incorporating a choke assembly 118. Fluid flow through the annulus 106 is either permitted or not permitted during an uninhibited insertion process of the tubing 14 through the borehole 10. When the flow interruptor 116 is activated due to a sensed or otherwise detected friction issue, fluid flow through the opening 120 is sharply and momentarily stopped by the choke assembly 118. This causes a back pressure/pulse wave 82 that will flow into the flowbore 104 and provide the pressure pulses necessary for friction reduction. The actuator 122 drives a rod 124 having a head 126 that engages a seat assembly 128. The actuator 122 repeatedly engages and disengages the head 126 and the seat assembly 128 to form a series of friction reducing pulse waves 82. One or all of the actuator 122, rod 124, head 126, and seat assembly 128 may all be annular shaped to fit within the annulus 106 of the flow interruptor 116.

Figure 6A:
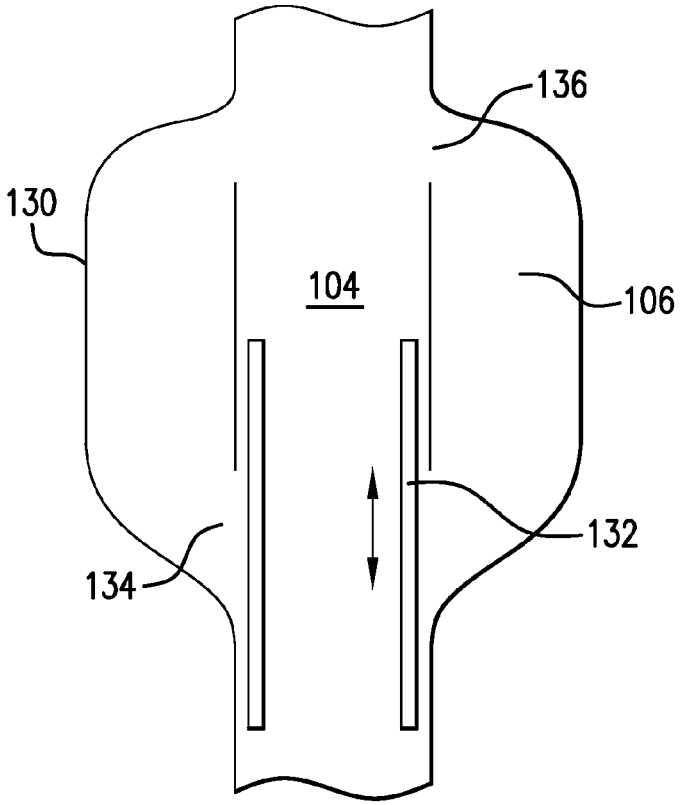
FIG. 6A shows a cross sectional view of an exemplary embodiment of an annulus type friction reduction sub with a reciprocating tubular valve.
Figure 6B:
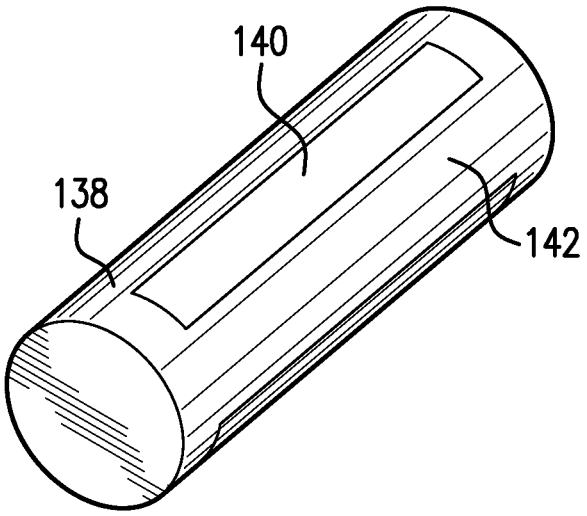
FIG. 6B shows a perspective view of a rotatable slotted tubular valve.

In yet another exemplary embodiment of a flow interruptor 130 shown in FIG. 6A, a valve gate 132 is illustrated having a tubular shape that allows or prevents entry of fluid into the annulus 106 of the flow interruptor 130. The valve gate 132 may be reciprocated axially back and forth, such as via an actuator as shown in FIG. 5, in alternating downhole and uphole directions to alternately permit and block fluid flow into the annulus 106 from a downstream opening 134 and send the resultant pressure pulse waves 82 back into the flow bore 104 through an upstream opening 136 of the annulus 106 into the flowbore 104. Alternatively, as shown in FIG. 6B, a tubular valve gate 138 includes slotted openings 140 and blocking portions 142 that alternatingly align and misalign with openings into the annulus 106 of an annulus type flow interruptor 105 such that pulses 82 are created when the tubular valve gate 138 is axially rotated within the flowbore 104. Rotation of the tubular valve gate 138 may be made possible via a magnet moving towards and away from an oppositely charged portion of the valve gate 138. Alternatively, the tubular valve gate 138 includes openings 140 surrounded by turbine blades such that the gate 138 rotates by the fluid moving past it in the activated state. The valve gate 138 is restrainable in a non-activated state by an electrically activated braking mechanism, which may take the form of a simple extendable bar that passes in and out of one of the openings 140 or a magnetically attracted brake that moves away from the valve gate 138 in the activated state.

Figure 7A:
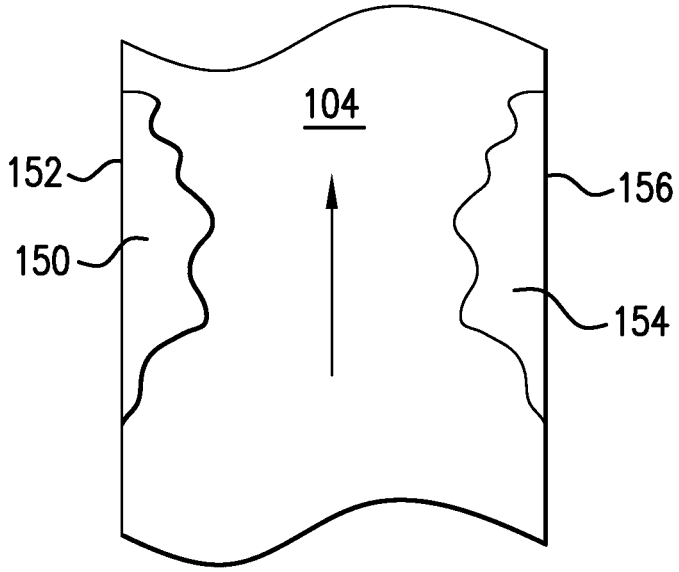
FIGS. 7A and 7B show cross sectional views of an exemplary embodiment of a restrictor type friction reduction sub having an inflatable bladder.
Figure 7B:
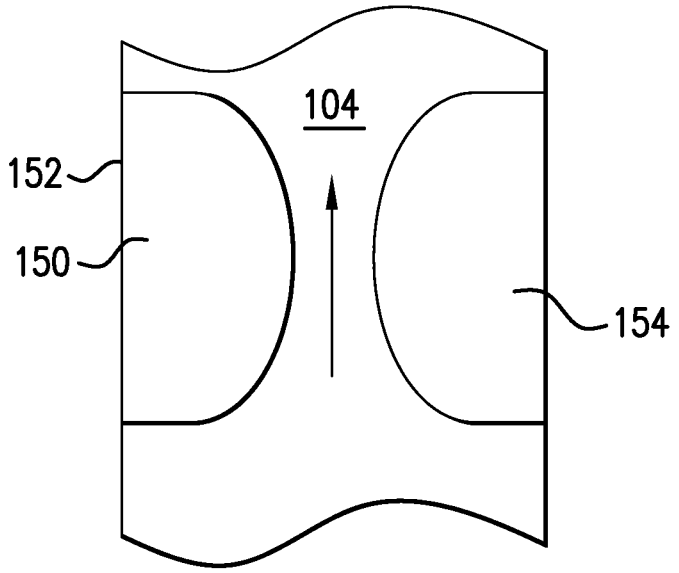
Figure 8A:
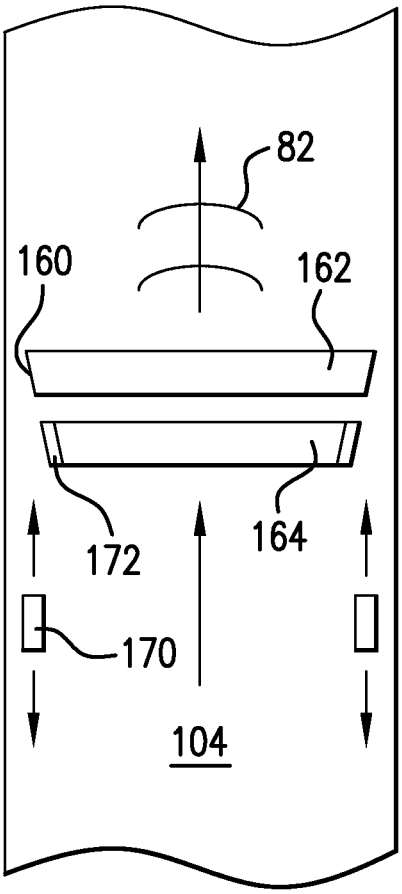
FIG. 8A shows a cross sectional view of an exemplary embodiment of a restrictor type friction reduction sub having a rotatable restrictor.
Figure 8B:
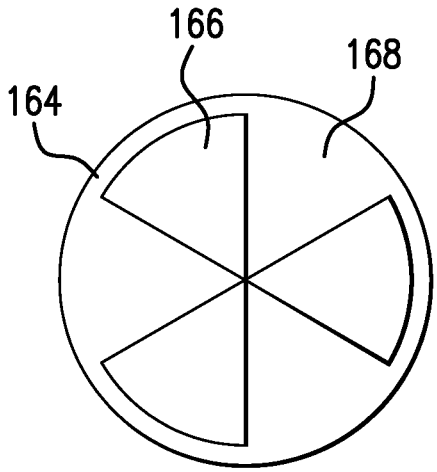
FIGS. 8B and 8C show plan views of exemplary restrictors for use in the friction reduction sub.
Figure 8C:
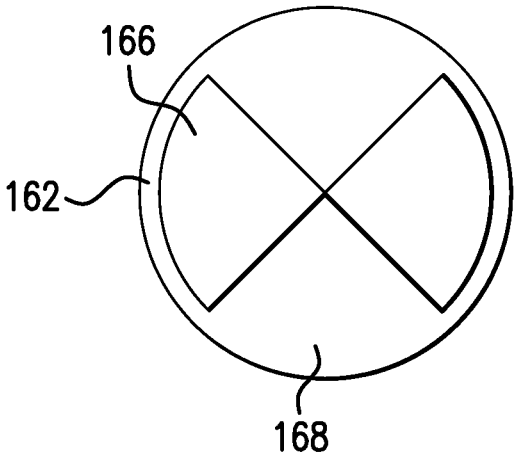

In the embodiments described above, the flow interruptor 50 does not block flow through the flowbore 104. Alternatively, the flow interruptor 50 includes a restrictor that alternately restricts and permits flow through the flowbore 104, but does not completely prevent flow through the flowbore 104 even during restriction. An exemplary embodiment of a flow restrictor 150 for a flow interruptor 152 is shown in FIGS. 7A and 7B. A pneumatically operated bladder 154 is shown attached to an interior wall 156 of the flow interruptor 152. When activated by the power supply 46, the bladder 154 is alternately inflated and deflated to restrict (as shown in FIG. 7B) and more readily permit (as shown in FIG. 7A) fluid passing therethrough. Such a bladder 154 may also be employed in an annulus 106 where the annulus 106 is alternately completely blocked and reopened by the bladder 154. Another exemplary embodiment of a flow restrictor 160 is shown in FIGS. 8A to 8C where a fixed restrictor 162 and a rotatable restrictor 164 include different flowthrough openings 166 and blocking portions 168 such that rotation of the rotatable restrictor 164 relative to the fixed restrictor 162 alternately aligns and misaligns the flowthrough openings 166 and blocking portions 168 to create pressure waves 82 usable for friction reduction. In an exemplary embodiment, rotation of the rotatable restrictor 164 is accomplished via movement of a magnet 170 axial towards and away from an oppositely magnetically charged rim 172 of the rotatable restrictor 164. While simple flow through openings 166 are shown in FIGS. 8B and 8C, any number of alternate openings and shapes may be employed to create the desired pulses 82.

Figure 9A:
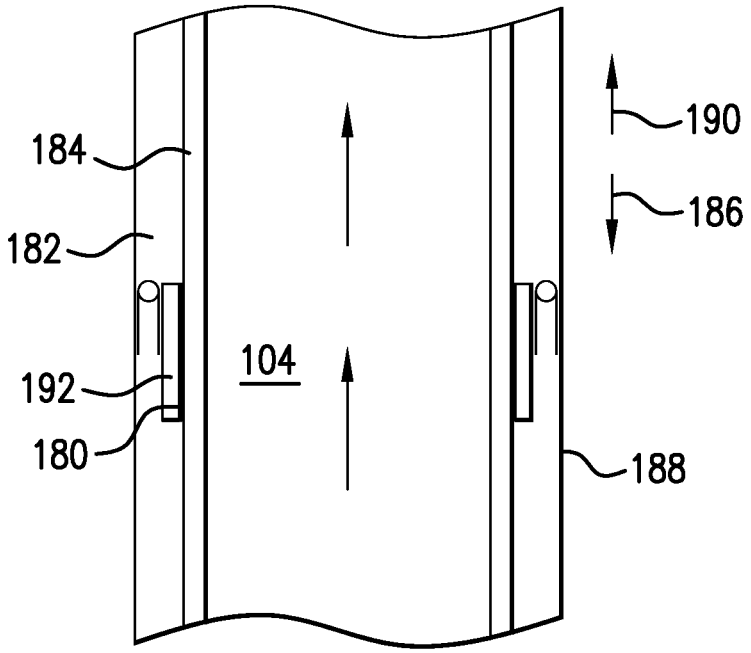
FIGS. 9A and 9B show cross sectional views of an exemplary embodiment of a restrictor type friction reduction sub having spring biased vanes.
Figure 9B:
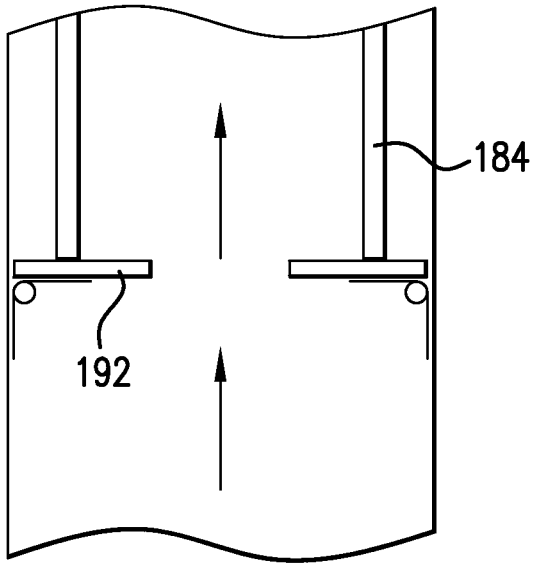

As shown in FIGS. 9A and 9B, yet another exemplary embodiment of a flow restrictor 180 for a flow interruptor 182 includes a reciprocating flow tube 184 that is normally biased in a downhole direction 186 to restrain the flow restrictor 180 against the wall 188 of the flow interruptor 182. When pulses 82 are required to reduce friction between the tubing 14 and formation wall 16 or casing 12, the flow tube 184 is moved in an uphole direction 190 to allow spring biased vanes 192 to extend within the flowbore 104 and at least partially block flow therethrough. Repeated movements of the flow tube 184 in opposite axial directions 186, 190, such as via the actuator shown in FIG. 5, will move the vanes 192 in and out of the flowbore 104 to create the desired friction reducing pulses 82. The vanes 192 do not block the flowbore 104 when in the extended condition shown in FIG. 9B.

Figure 10:
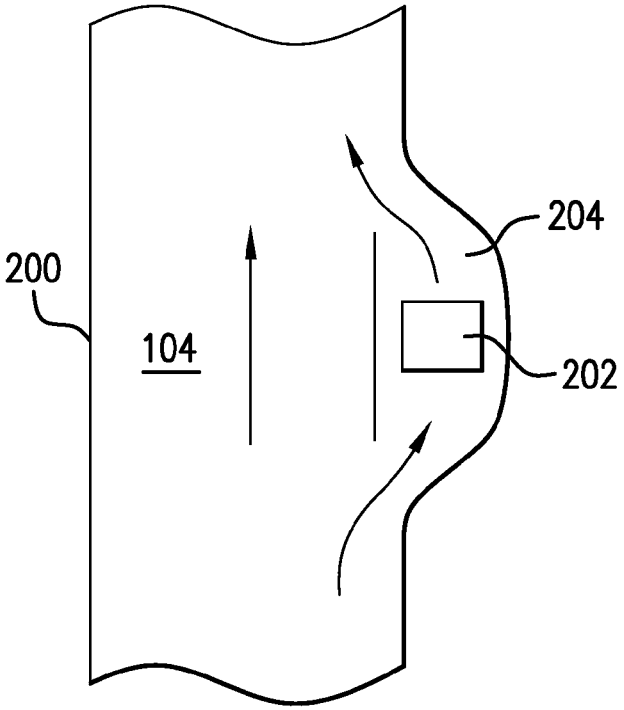
FIG. 10 shows a cross sectional view of an exemplary friction reducer in a side pocket type friction reduction sub.

As shown in FIG. 10, in yet another exemplary embodiment of a flow interruptor 200, a friction reducer 202 is positioned within a side pocket 204 of the flow interruptor 200, rather than in an annulus 106 or extending into the flowbore 104. Any of the above described embodiments of friction reducers for friction reduction may be incorporated into such a side pocket 204.

Figure 11:
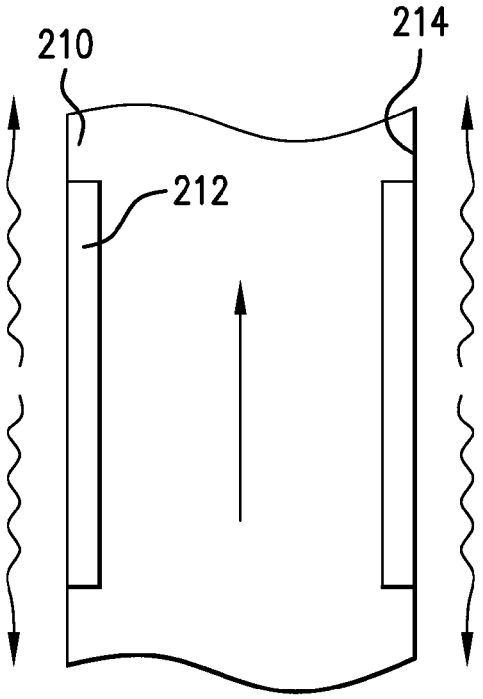
FIG. 11 shows a cross sectional view of an exemplary embodiment of a friction reduction sub having a vibration mechanism.

The exemplary embodiments of friction reducers for a flow interruptor have primarily involved the creation of pulses within the flowbore 104 for inducing friction reduction. As shown in FIG. 11, in another exemplary embodiment, a flow friction reduction sub 210 utilizes a vibration mechanism 212 as a friction reducer. The vibration mechanism 212 of FIG. 11 is positioned on a wall 214 of the sub 210 and when activated by the power supply sub 48, vibrates the wall 214 of the sub 210. While flow through the flowbore 104 of the sub 210 is inevitably affected by activation of the vibration mechanism 212 to produce a more turbulent flow therein, the vibration mechanism 212 serves primarily to vibrate the wall 214 of the sub 210 to reduce friction between the tubing 14 and the casing 12 or formation wall 16. That is, the vibrational energy of the wall 214 of the sub 210 travels to the walls 44 of the tubing 14. The vibration mechanism 212 need only be activated on an as needed basis, as determined by the sensors 36 or 28 or operator, and therefore power requirements for activating such a vibration mechanism 212 are temporary.

Figure 12:
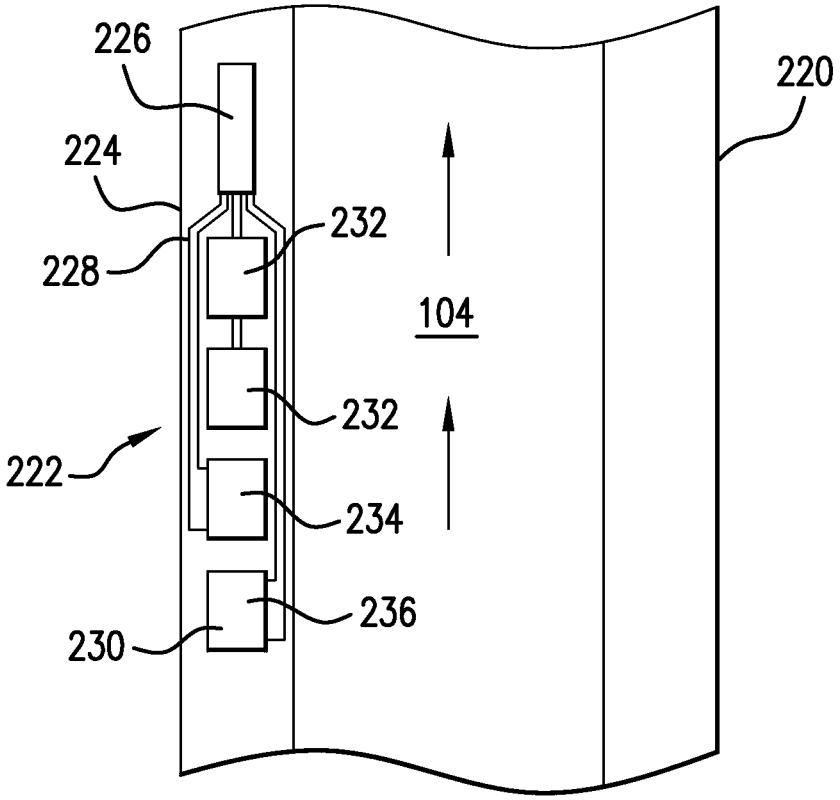
FIG. 12 shows a cross sectional view of an exemplary embodiment of a friction reduction sub having a ballistically actuatable friction reducer.

As shown in FIG. 12, yet another exemplary embodiment of an electrically activated friction reduction sub 220 is shown. The sub 220 includes a ballistically operated friction reducer 222 using technology employed in perforating guns, such as described in U.S. Patent Application No. 2011/0024116 to McCann et al. While perforating guns employ high explosives capable of collapsing a liner and perforating a casing and surrounding formation, the explosives employed in the sub 220 are not capable of perforating the wall 224 of the sub 220 and are of a scale only capable of inducing movement of the sub 220. Movement of the sub includes a shock type movement that may be sufficient to dislodge a tubing 14 from a lockup situation. When the sensors 28 or 36 or operator determines a lockup of the tubing 14 and a signal is sent to the power supply sub 48 indicative of the lockup, an electrical signal is sent to an initiator 226 which selectively ignites a specific detonation cord 228. The detonation cord 228 initiates a specific shaped charge 230 for detonation. Multiple successive shaped charges 232 may be interconnected for successive detonation which provides a prolonged time span of movement of the sub 220. Shaped charges 234, 236 may also be separately connected to the initiator 226 for detonation on an as needed basis. For example, if a sensor 28 or 36 determines that the tubing 14 is still in a lockup situation following detonation of a shaped charge 234, then an additional charge 236 is detonated, and so on, until the tubing 14 is free to continue insertion into the borehole 10. Detonation of the shaped charges 236 moves the wall 224 of the sub 220 and therefore inevitably interrupts the normal flow through the flowbore 104 but does not block the flow therethrough. The turbulence caused by the detonations is usable by a power generation sub as described above.

Any of the above described embodiments of an electrically operated flow interruptor and friction reduction sub may be used in plurality and sections of tubing 14 may be interposed therebetween. More than one friction reduction sub 50 may be connected to and operated by a single power supply sub 48. While fluid flow is illustrated in one particular direction, it should be understood that the fluid flow within the flowbores 42, 58, 66, 104 of the above described exemplary embodiments may be in either uphole or downhole direction depending upon the particular application of the string. Likewise, direction of the pressure waves 82 may be in a different direction depending on the direction of the fluid flow.

A method of reducing friction in a downhole tubular includes inserting a tubular such as the tubing 14 into the borehole 10, sensing a lockup of the tubular within the borehole 10, sending a signal to a power source or supply 46 in response to the sensed lockup, powering an electrically activated friction reduction sub 50 by the power source, the friction reduction sub 50 having a flow bore 104 fluidically connected to a flowbore 42 of the tubular, the sub 50 further having a friction reducer, such as the pulsers shown in FIGS. 4-10 or vibrators shown in FIGS. 11-12, and reducing friction between the tubular and surrounding borehole 10 by operation of the friction reducer. Flow through the flowbores 42, 104 of the tubular 14 and sub 50 is not blocked during activation and non-activation of the friction reduction sub. The method further includes generating power in a power generating sub 48 as a result of activation of the sub 50. In one exemplary embodiment, powering the electrically activated sub 50 includes creating pulses 82 in the flowbore 42 of the tubular, such as by moving a valve to initiate pulsing in an annulus 106 or side pocket 204 of the sub 50. In another exemplary embodiment, powering the sub 50 includes creating movement in a wall of the sub 50. Sensing the lockup of the tubular may include sensing a decrease of movement of the tubular by a downhole sensor 36.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A friction reduction assembly for a downhole tubular, the friction reduction assembly comprising:

an electrically activated friction reduction sub including:

a flowbore fluidically connected to a flowbore of the tubular and remaining open for fluid flow therethrough during both activated and non-activated states of the friction reduction sub; and a friction reducer, the friction reducer including a pulser positioned within one of an annulus surrounding the flowbore of the friction reduction sub and a side pocket of the friction reduction sub, an entry opening of the annulus or side pocket in fluidic communication with the flowbore of the tubular, an exit opening of the annulus or side pocket in fluidic communication with the flowbore of the tubular, the friction reduction sub, in the activated state, configured to redirect a portion of fluid from the flowbore of the friction reduction sub through the annulus or side pocket and back into the flowbore of the friction reduction sub along a flowpath from the flowbore of the friction reduction sub through the entry opening, through the pulser, through the exit opening, and back into the flowbore of the friction reduction sub, fluidic pulses created in the fluid in the activated state by the pulser in fluidic communication with the exit opening and the flowbore of the tubular and passed directly into the flowbore of the friction reduction sub by the exit opening along the flowpath, the friction reduction sub further configured to block the fluid from passing through the pulser in the non-activated state of the friction reduction sub;

wherein friction between the tubular and surrounding casing or borehole is reduced in the activated state of the friction reduction sub.

2. The friction reduction assembly of claim 1, wherein the pulser is positioned within the annulus surrounding the flowbore of the friction reduction sub.

3. The friction reduction assembly of claim 1, wherein the pulser is positioned within the side pocket of the friction reduction sub.

4. The friction reduction assembly of claim 1, wherein the friction reducer further includes an electrically activated valve permitting access to the pulser in the activated state and blocking access to the pulser in the non-activated state.

5. The friction reduction assembly of claim 1, further comprising a power generation sub and pulses from the pulser are used to generate power in the power generation sub.

6. The friction reduction assembly of claim 1, wherein the friction reducer includes a valve blocking access to a portion of the friction reduction sub in the non-activated state and permitting access to the portion of the friction reduction sub in the activated state.

7. The friction reduction assembly of claim 1 further comprising a sensor detecting a lockup of the downhole tubular.

8. The friction reduction assembly of claim 7, further comprising a logging bottom hole assembly having the sensor.

9. A method of reducing friction in a downhole tubular, the method comprising:

inserting a tubular having a flowbore into a borehole;

sensing a lockup of the tubular within the borehole;

activating an electrically activated friction reduction sub subsequent to a sensed lockup of the tubular, the friction reduction sub having a flowbore fluidically connected to the flowbore of the tubular and remaining open for fluid flow therethrough during both activated and non-activated states of the friction reduction sub, the friction reduction sub further including a friction reducer, the friction reducer including a pulser positioned within one of an annulus surrounding the flowbore of the friction reduction sub and a side pocket of the friction reduction sub, an entry opening of the annulus or side pocket in fluidic communication with the flowbore of the tubular, an exit opening of the annulus or side pocket in fluidic communication with the flowbore of the tubular, the friction reduction sub, in the activated state, configured to redirect a portion of fluid from the flowbore of the friction reduction sub, through the annulus or side pocket and back into the flowbore of the friction reduction sub, along a flowpath from the flowbore of the friction reduction sub, through the entry opening, through the pulser, through the exit opening, and back into the flowbore of the friction reduction sub, fluidic pulses created in the fluid in the activated state by the pulser in fluidic communication with the exit opening and the flowbore of the tubular and passed directly into the flowbore of the friction reduction sub by the exit opening along the flowpath to create fluidic pulses in the flowbore of the tubular, the friction reduction sub further configured to block the fluid from passing through the pulser in the non-activated state of the friction reduction sub; and reducing friction between the tubular and surrounding borehole in the activated state of the friction reduction sub.

10. The method of claim 9 further comprising harvesting energy in a power generation sub as a result of activation of the friction reduction sub.

11. The method of claim 9 wherein creating pulses includes moving a valve to initiate pulsing in the annulus or the side pocket of the friction reduction sub.

* * * * *